US005157374A

United States Patent [19]

Suyama

[11] Patent Number: 5,157,374

[45] Date of Patent: Oct. 20, 1992

[54] ALARM BUZZER AND ACCESSORY

[76] Inventor: Ikuo Suyama, 1001-20, Nishiterakatamachi, Hachioji-shi, Tokyo(192-01), Japan

[21] Appl. No.: 753,524

[22] Filed: Sep. 3, 1991

[30] Foreign Application Priority Data

Sep. 5, 1990 [JP] Japan ..... 2-93226

[51] Int. Cl.[5] ..... G08B 3/00

[52] U.S. Cl. ..... 340/384 R; 340/321; 340/546

[58] Field of Search ..... 340/328, 384 E, 388, 340/391, 321, 384 R, 546

[56] References Cited

U.S. PATENT DOCUMENTS 3,345,627 10/1967 Herst et al. ..... 340/388
3,432,843 3/1969 Spring ..... 340/546
3,614,763 10/1971 Yannuzzi ..... 340/321
4,075,626 2/1978 Sakaguchi et al. ..... 340/388
4,183,017 1/1980 Sims ..... 340/384 R
4,404,549 9/1983 Berg ..... 340/321
4,633,232 12/1986 Nelson et al. ..... 340/546

*Primary Examiner*—Jin F. Ng
*Assistant Examiner*—Dov Popovici
*Attorney, Agent, or Firm*—Joseph C. Mason, Jr.; Ronald E. Smith

[57] ABSTRACT

An alarm buzzer produce an alarm sound from a sound-producing device installed in a hollow container in which an opening through which the sound is sent out is arranged not in the face opposite the sound-producing face of the device but in one or both of the back and side faces other than said face opposite said sound-producing face so that sound amplification is achieved through Helmholtz resonance.

4 Claims, 2 Drawing Sheets

ALARM BUZZER AND ACCESSORY

BACKGROUND OF THE INVENTION

1. Field of the Invention

This invention relates to an alarm buzzer and an accessory and more particularly, to an alarm buzzer that is compact and produces a loud alarm sound and an accessory that contains the alarm buzzer.

2. Description of the Prior Art

An alarm buzzer that has a sound-producing device installed in a hollow container and an opening for sending out the produced sound, which may be in the form of a slit or a round hole, in the face opposite the sound-producing face of the sound-producing device is well known. In other words, the opening in the container through which the sound escapes is straight across from, i.e., opposite from the sound-producing face of the sound-producing device. Thus, sound travels directly, i.e., in a straight line to the opening and no amplification of the sound occurs.

Also a compact alarm buzzer designed so that it can be put easily for instance in a handbag to be easily carried is well known.

A problem encountered in alarm buzzers based on the prior art is that the volume of the sound is determined by the area size of the sound-producing face, that is, an alarm buzzer must be big in size in order to produce a loud sound, which causes inconveniences in carrying the buzzer, and yet a compact alarm buzzer cannot produce an alarm sound loud enough for practical purposes.

A second problem is that in an urgent situation the user probably has little time for searching the location such as in a handbag for the alarm buzzer and turning on the switch of the buzzer, and in that case carrying the alarm buzzer becomes meaningless.

A third problem is that a conventional alarm buzzer lacks appeal to the users and not many people carry the buzzers except when they are expecting to come home late at night, and especially children or aged people hate carrying the buzzer.

SUMMARY OF THE INVENTION

It is therefore a first object of the present invention to provide a compact alarm buzzer which produces a loud sound.

A second object of the present invention is to provide an accessory containing an alarm buzzer so that the user can sound the alarm easily and quickly in an urgent situation and also can carry the buzzer without annoyance.

To accomplish the first object, the invention provides an alarm buzzer, which produces an alarm sound from a sound-producing device installed in a hollow container, characterized in that an opening through which the sound is sent out is arranged not in the face opposite the sound-producing face of the sound-producing device as taught by the prior art, but in one or both of the back and side faces of said container against said face opposite said sound-producing face of the sound-producing device.

To accomplish the second object, the present invention provides an accessory having patterns on the front face and a fitting attached to the rear face, characterized in that the opening for sending out the sound is arranged in a face other than the face opposite the sound-producing face of the sound-producing device therein.

An alarm buzzer, according to the aforesaid first object of the present invention, does not have an opening in the face opposite the sound-producing face of the sound-producing device in the container. As a result, an alarm sound produced from said sound-producing face is reflected on the face opposite the sound-producing face, and the air inside the container starts moving backward and forward as a mass as a piston does, which is known as Helmholtz resonance. Furthermore, the alarm sound having a resonance frequency determined by the dimensions of the container is sent out to outside at a sound pressure higher than that of the sound produced from the sound-producing face through one or two openings arranged in one or both of the back and side faces against said face opposite said sound-producing face.

Therefore, the alarm buzzer according to this invention produces a louder sound than a conventional alarm buzzer even if the two buzzers have the same size. Alternatively, the alarm buzzer can be more compact that a conventional alarm buzzer even if the two buzzers produce the same volume of sound.

An accessory, according to the aforesaid second object of the present invention, has a hollow inside where the sound-producing device is installed and an opening for sending out the sound is arranged in a face other than the face opposite the sound-producing face of the sound-producing device therein.

For this reason, said accessory functions as the alarm buzzer according to the first object of this invention, and therefore the user wearing said accessory can sound the alarm sound easily and quickly even in an urgent situation. Moreover, the user can carry said accessory without difficulty and annoyance, and especially children and aged people become more willing to carry said accessory.

DESCRIPTION OF THE PREFERRED EMBODIMENTS

Description of this invention is hereinunder made in detail with reference to the drawings showing the embodiments. Although particular embodiments of this invention are shown and described herein, various changes and modifications may be made in this invention.

Figure 1:
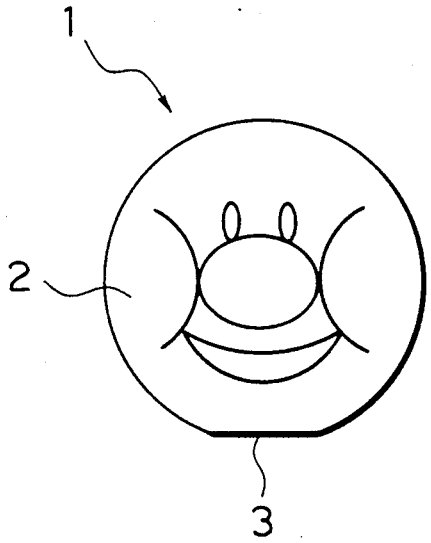
FIG. 1 illustrates the front face of the accessory of the first embodiment according to this invention.
Figure 2:
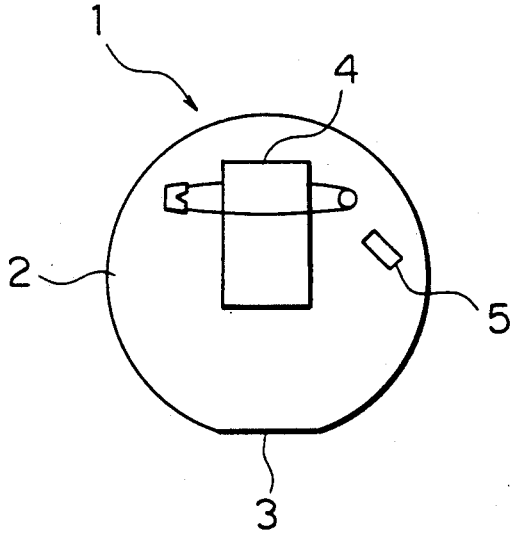
FIG. 2 illustrates the rear face of the accessory of the first embodiment according to this invention.
Figure 3:
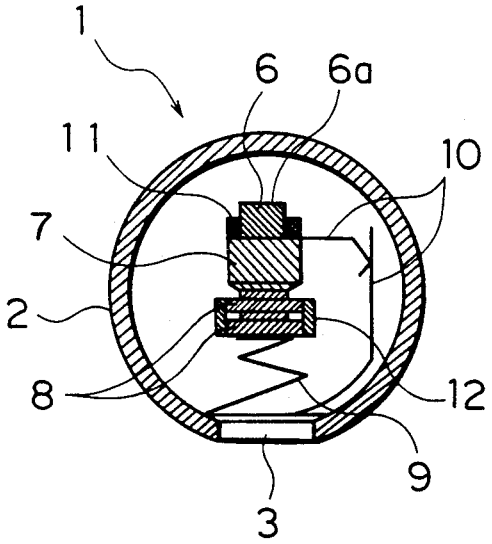
FIG. 3 illustrates the cross-section of the accessory of the first embodiment according to this invention.

FIG. 1, FIG. 2 and FIG. 3 illustrate the front face, the rear face, and the cross-section respectively, of an accessory 1 of the first embodiment according to this invention.

The accessory 1 comprises a hollow container 2 having patterns flatly or solidly arranged in the front face thereof.

The hollow container 2 has an opening 3 at a first preselected location for sending out the alarm sound arranged at the bottom thereof.

The hollow container 2 has a fitting 4 wherein a clip and a safety pin are formed monolithically, and a switch which is used to start or stop sounding of the alarm sound on the rear face thereof.

Said hollow container 2 has a hollow inside where the sound-producing device 6, a drive section of the sound-producing device 7, a battery 8, a spring 9 and a contact 10 are arranged.

The sound-producing device 6 is supported by a sounding-producing supporting column 11 in the position with the sound-producing face 6*a* thereof facing the inner wall of said hollow container 2 at a second preselected location, as shown in FIG. 3. Note the closely spaced relationship of said sound-producing face 6*a* and said inner wall. Note also that sound emitted from said sound-producing face 6*a* must reflect off the inner wall of the container at said second preselected location before it can exit the container through the opening 3 at the remote first preselected location; this results in sound amplification as a result of Helmholtz resonance as mentioned earlier.

The battery 8 is supported by a battery supporting tool 12.

The contacts 10 are switched on or off by said switch 5. When said contacts 10 are switched on, the alarm sound is produced from said sound-producing face 6*a* of said sound-producing device 6.

The aforesaid accessory 1 has the hollow container 2 in which an alarm sound is reflected and resonated, thus said accessory 1 can produce a loud sound even though it is compact. Furthermore, said accessory 1 can be attached directly to the user's body, which enables the user to operate said accessory 1 quickly and easily even in an urgent situation. Also, being an accessory, said accessory 1 has much appeal to the users to wear it, and especially children will love carrying it.

Figure 4:
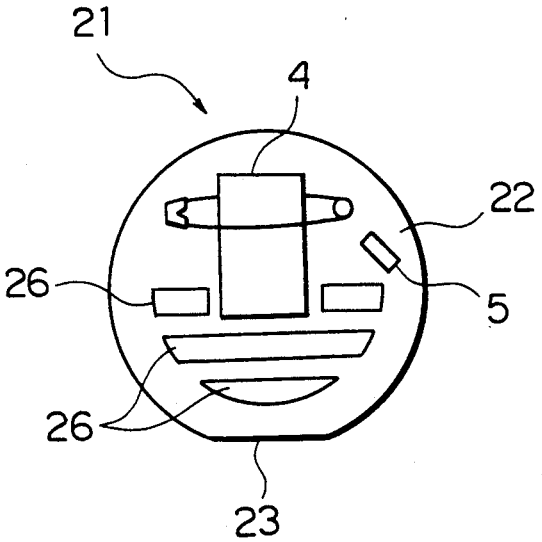
FIG. 4 illustrates the rear face of the accessory of the second embodiment according to this invention.

There is second embodiment of this invention, which is an accessory 21 illustrated by FIG. 4.

In the accessory 21, the alarm buzzer installed in a hollow container 22 is the same as in accessory 1.

The hollow container 22 has an opening 23 in the the back face thereof against the face opposite the sound-producing face 6*a* of the sound-producing device 6, and a plurality of openings 26 in the side face thereof against said face opposite said sound-producing face 6*a* of said sound-producing device 6, but does not have an opening in said face opposite said sound-producing face 6*a* of said sound-producing device 6 therein.

Other embodiments of this invention include said accessory 1 in the form of a small pendant or a nameplate.

An alarm buzzer according to this invention is small in size, yet can produce a loud sound. In addition to the above effect, an accesory according to this invention can easily be operated by the users, so that the users are willing to carry it.

What is claimed is:

1. An alarm buzzer, comprising:

a hollow container;

a sound producing device positioned within said hollow container;

said sound producing device having a sound-producing face;

said hollow container having an opening formed therein through which sound produced by said sound-producing device may escape;

said opening being formed in said container at a first preselected location;

said sound-producing face being disposed in closely spaced relation to an inner wall of said container at a second preselected location within said container;

said first and second preselected locations being remote from one another so that sound emitted by said sound-producing device is constrained to reflect off said inner wall of said container at least once before exiting said container through said opening, whereby an amplification of sound is produced as a result of Helmholtz resonance.

2. The alarm buzzer of claim 1, wherein an outside of said container is provided with preselected patterns to render the container suitable for wearing as an accessory item of clothing, and wherein an on-off switch is provided at a convenient location on said container so that a wearer may easily activate the sound-producing device.

3. An alarm buzzer, comprising:

a hollow container;

a sound-producing device positioned within said hollow container;

said sound-producing device having a sound-producing face;

said hollow container having a plurality of openings formed therein through which sound produced by said sound-producing device may escape;

said plurality of openings being formed in said container at a plurality of first preselected locations;

said sound-producing face being disposed in closely spaced relation to an inner wall of said container at a second preselected location within said container;

said second preselected location being remote from all of said first preselected locations so that sound emitted by said sound-producing device is constrained to reflect off said inner wall of said container at least once before exiting said container through said plurality of openings, whereby an amplification of sound is produced as a result of Helmholtz resonance.

4. The alarm buzzer of claim 3, wherein an outside of said container is provided with preselected patterns to render the container suitable for wearing as an accessory item of clothing, and wherein an on-off switch is provided at a convenient location on said container so that a wearer may easily activate the sound-producing device.

* * * * *